US009589751B2

(12) United States Patent
Takahashi et al.

(10) Patent No.: US 9,589,751 B2
(45) Date of Patent: Mar. 7, 2017

(54) SEALED RELAY

(71) Applicant: MEIDENSHA CORPORATION, Tokyo (JP)

(72) Inventors: Daizo Takahashi, Numazu (JP); Toshimasa Fukai, Shizuoka (JP); Masahiko Ieda, Mishima (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 14/896,045

(22) PCT Filed: May 28, 2014

(86) PCT No.: PCT/JP2014/064104

§ 371 (c)(1),
(2) Date: Dec. 4, 2015

(87) PCT Pub. No.: WO2014/196427

PCT Pub. Date: Dec. 11, 2014

(65) Prior Publication Data

US 2016/0133405 A1 May 12, 2016

(30) Foreign Application Priority Data

Jun. 6, 2013 (JP) ..... 2013-119364

(51) Int. Cl.
*H01H 33/662* (2006.01)
*H01H 33/64* (2006.01)
(Continued)

(52) U.S. Cl.
CPC ..... *H01H 33/662* (2013.01); *H01H 33/64* (2013.01); *H01H 50/023* (2013.01);
(Continued)

(58) Field of Classification Search
CPC .. H01H 2205/002; H01H 50/60; H01H 71/08; H01H 13/52; H01H 15/24;
(Continued)

(56) References Cited

U.S. PATENT DOCUMENTS 3,562,682 A * 2/1971 Owada ..... H01H 33/668 335/201
3,843,856 A * 10/1974 Attia ..... H01H 1/0203 200/266

(Continued)

FOREIGN PATENT DOCUMENTS

JP 59-203326 A 11/1984
JP 64-84533 A 3/1989

(Continued)

OTHER PUBLICATIONS

U.S. Appl. No. 14/896,035, filed Dec. 4, 2015, Meidensha Corporation.

(Continued)

*Primary Examiner* — Truc Nguyen
(74) *Attorney, Agent, or Firm* — Foley & Lardner LLP

(57) ABSTRACT

Conventional example is arranged simply to turn a circuit on/off, and not to changeover connection.
Sealed relay 1 comprises: insulating tube 2; first relay connect portion 4 attached to one end of insulating tube 2, and provided with first contact 3 on inside surface; second relay connect portion 5 disposed in confrontation with first relay connect portion 4 in insulating tube 2; movable member 7 disposed movably between first and second relay connect portions 4 and 5, and provided with second contact 6 contacting with first contact 3 when moved toward the first relay connect portion; and operating mechanism to move the movable member. Third relay connect portion 10 including third contact 9 is provided between the second and first relay connect portions. Movable member 7 includes a fourth
(Continued)

contact contacting with the third contact when the first and second contacts are out of contact from each other.

3 Claims, 2 Drawing Sheets

(51) Int. Cl.
*H01H 50/02* (2006.01)
*H01H 50/54* (2006.01)

(52) U.S. Cl.
CPC ..... *H01H 50/546* (2013.01); *H01H 33/66207* (2013.01); *H01H 2033/66223* (2013.01); *H01H 2205/002* (2013.01)

(58) Field of Classification Search
CPC ..... H01H 19/025; H01H 2033/6667; H01H 2231/052; H01H 2235/01; H01H 33/38; H01H 33/6662; H01H 3/46; H01H 50/02; H01H 50/021
See application file for complete search history.

(56) References Cited

U.S. PATENT DOCUMENTS 5,892,194 A * 4/1999 Uotome ..... H01H 1/34 218/68
2010/0224472 A1* 9/2010 Horikoshi ..... H01H 13/52 200/345
2012/0044030 A1* 2/2012 Wu ..... H01H 50/44 335/136
2012/0319806 A1* 12/2012 Mills ..... H01H 50/12 335/185
2013/0057369 A1* 3/2013 Yano ..... H01H 1/66 335/156
2013/0342292 A1* 12/2013 Choi ..... H01H 50/00 335/192
2015/0084721 A1* 3/2015 Ziegler ..... H01H 71/2418 335/18

FOREIGN PATENT DOCUMENTS

JP 1-204322 A 8/1989
JP 10-284347 A 10/1998
JP 10-340655 A 12/1998
JP 2002-313197 A 10/2002
JP 2005-259543 A 9/2005
JP 2006-172847 A 6/2006
JP 2006-332388 A 12/2006
JP 2009-4607 A 1/2009
JP 2009-76218 A 4/2009

OTHER PUBLICATIONS

USPTO Office Action, U.S. Appl. No. 14/896,035 (U.S. Pat. No. 3,594,754, U.S. Pat. No. 4,272,661, U.S. Pat. No. 5,191,180, U.S. Pat. No. 6,144,005, U.S. Pat. No. 6,268,995, U.S. Pat. No. 6,587,328, U.S. Pat. No. 6,884,940, 2005/0162807, U.S. Pat. No. 7,041,930, 2006/0266739, 2012/0187090, 2013/0075368), Sep. 15, 2016.
Chinese Office Action, Oct. 8, 2016, 6 pages.

* cited by examiner

SEALED RELAY

TECHNICAL FIELD

The present invention relates to a sealed relay to move a movable member with an operating mechanism and thereby set a movable side contact (contact point) in contact with a fixed side contact to make connection with an external circuit, such as a vacuum relay or a gas enclosed relay containing insulating gas such as SF (sulfur hexafluoride) gas or dry air.

BACKGROUND ART

FIG. 2 shows a known vacuum switch. A vacuum switch 101 includes a fixed side contact 103 and a movable side contact 104 in an insulating tube 102. Vacuum switch 101 makes electrical connection between an upper conductor 106 and a lower conductor 107 by moving movable side contact 104 with an operating mechanism 105 and setting movable side contact 104 in contact with fixed side contact 103. Vacuum switch 101 breaks the electrical connection between upper and lower conductors 106 and 107 by setting movable side contact 104 out of contact with fixed side contact 103. A member 108 is a fixed side sealing metallic member attached to an opening in one end portion of the insulating tube 102. The fixed side contact 103 and upper conductor 106 are attached to the fixed side sealing metallic member 108. A member 109 is a movable side sealing metallic member attached to an opening in the other end portion of insulating tube 102. The movable side contact 104 and lower conductor 107 are attached to the movable side sealing metallic member 108. A member 110 is a bellows to hold a vacuum inside the insulating tube 101. (Document 1)

PRIOR ART DOCUMENT(S)

Patent Document

Patent Document 1: JP2006-172847A

SUMMARY OF THE INVENTION

Problem to be Solved by the Invention

As mentioned before, the vacuum switch 101 is arranged to connect the upper conductor 106 and lower conductor 107 electrically with each other by bringing the movable side contact 104 into contact with the fixed side contact 103 with operating mechanism 105, and to disconnect the upper conductor 106 and lower conductor 107 electrically from each other by moving the movable side contact away from fixed side contact 103 with operating mechanism 105. The thus-constructed vacuum switch 101 is simply designed to make and break the connection between the upper and lower conductors 106 and 107, and not designed to change over the circuit connection.

According to the present invention, an apparatus is arranged to change over the circuit connection as well as to make and break the connection between the upper and lower conductors.

Means for Solution of Problem

According to the present invention as defined in claim 1, a sealed relay comprises: an insulating tube; a first relay connect portion attached or fixed to an opening portion in one end of the insulating tube, and provided with a first contact on an inside surface of the first relay connect portion; a second relay connect portion disposed with a predetermined spacing from the first relay connect portion; a movable member disposed movably between the first and second relay connect portions, and provided with a second contact contacting with the first contact when the movable member is moved toward the first relay connect portion; an operating mechanism to move the movable member in a direction for contact and separation between the contacts; and a bellows to seal an inside of the insulating tube airtightly;

the sealed relay is arranged to set the first contact and the second contact in contact with each other by moving the movable member with the operating mechanism and thereby to connect the first and second relay connect portions electrically through the movable member and the bellows;

the sealed relay further includes a third relay connect portion including a third contact and being provided between the second relay connect portion and the first relay connect portion; and the movable member is provided with a fourth contact contacting with the third contact when the first contact and the second contact are set out of contact from each other.

According to certain embodiments of the present invention, in the sealed relay, the third and fourth contacts are ring-shaped or annular contacts having substantially equal diameters.

According to certain embodiments of the present invention, in the sealed relay, the first and second contacts are ring-shaped or annular contacts having diameters substantially equal to the diameters of the third and fourth contacts.

According to certain embodiments of the present invention, in the sealed relay, the bellows includes an inner circumferential bellows and an outer circumferential bellows arranged in a double structure, the inner circumferential bellows is configured to have a property for vacuum sealing, and the outer circumferential bellows is configured to have a property for electric conduction.

Effects of the Invention (1) According to certain embodiments of the present invention, when the movable member is moved to bring the first contact and the second contact into the non-contact state, the fourth contact provided in the movable member is brought into contact with the third contact provided in the third relay connect portion, and the second relay connect portion and the third relay connect portion are connected. Thus, the sealed relay can change over the connection of the circuit.

(2) According to certain embodiments of the present invention, the third and fourth contacts are ring-shaped or annular. Therefore, it is possible to increase the area of contact between both contacts to the advantage of RF (high frequency current) electric conduction. Furthermore, the ring-shaped third and fourth contacts facilitate the alignment of these contacts. Furthermore, it is possible to fix the third contact or/and the fourth contact readily by forming ring-shaped or annular groove(s) conforming to the third or fourth contact, in the movable member or the third relay connect portion, and fitting the ring-shaped contact in the corresponding groove.

(3) According to certain embodiments of the present invention, since the first and second contacts are ring-shaped or annular contacts having diameters substantially equal to the diameters of the third and fourth contact, it is possible to facilitate the circuit design as compared to the design in which the first and second contacts are shaped differently from the third and fourth contacts. (The difference in the contact shape results in the difference in capacitance and causes a difference in circuit constant between the section of the first and second contacts and the section of the third and fourth contacts in the circuit. Therefore, a circuit adjustment is required to make these even.) Furthermore, the first through fourth contacts having the same shape make it possible to reduce the number of constituent parts (the number of the kinds of the parts).

(4) According to certain embodiments of the present invention, the outer circumferential bellows is so made to have an ability to conduct or electric conductivity, and arranged to connect the movable member and the second relay connect portion electrically. Therefore, the sealed relay is adequate for conducting the great RF (high frequency) current. Furthermore, as compared to the example using multi contacts or flat knitting line, it is possible to reduce the size of the operating mechanism, to simplify the construction and reduce the operating force. Furthermore, since the bellows for electric conduction is used for electric connection, it is not necessary to use a conductive material such as copper alloy, as the material of the movable rod.

MODE(S) FOR CARRYING OUT THE INVENTION

Figure 1:
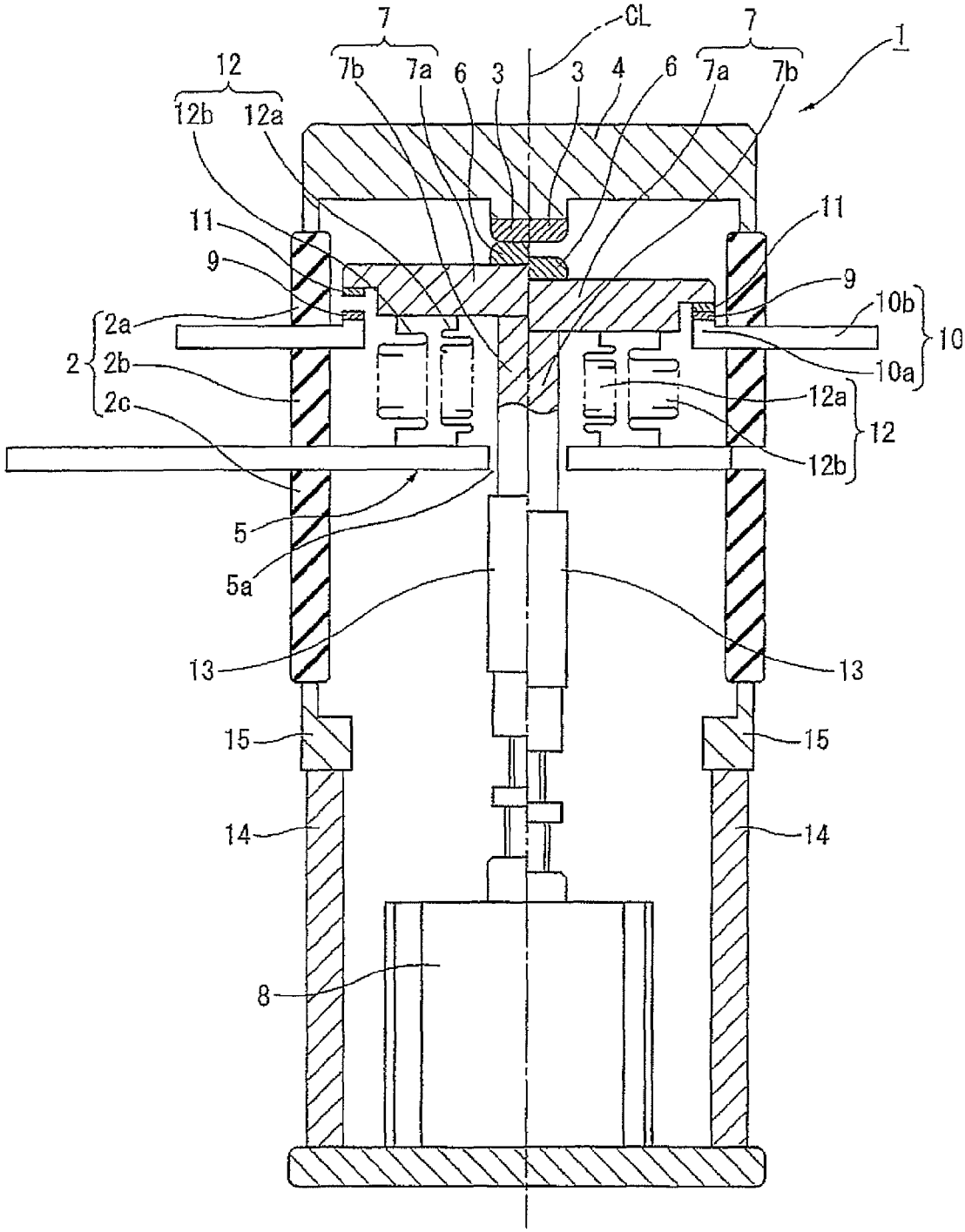
FIG. 1 is a sectional view showing a sealed relay according to the present invention. The left half on the left side of a center line CL shows a contact state in which a first contact and a second contact are in contact with each other. The right half of the center line CL shows a non-contact state of the first and second contacts.
Figure 2:
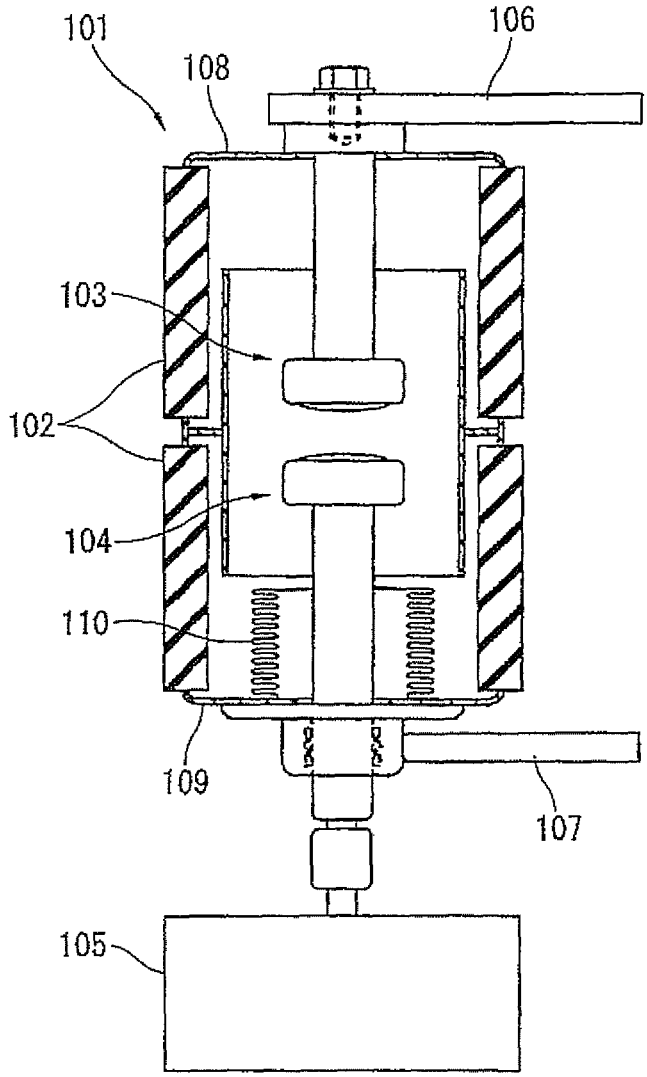
FIG. 2 is a sectional view of a conventional example.

An embodiment of the present invention is explained with reference to FIG. 1. FIG. 1 shows a vacuum relay 1 as an example of a sealed relay. The vacuum relay 1 includes: an insulating tube 1; a first relay connect portion 4 which is attached or fixed to an opening in one end of insulting tube 2 and which includes a first contact 3 in an inside surface; a second relay connect portion 5 disposed at a position confronting the first relay connect portion 3 across a predetermined spacing between the first and second relay connect portions, in insulating tube 2; a movable member 7 which is movable between first relay connect portion 4 and second relay connect portion 5 and which includes a second contact 6 to contact with the first contact 3 by movement toward the first relay connect portion 4; and an operating mechanism 8 to move the movable member 7 in an contact/separate direction for contact/separation of the first and second contacts 3 and 6.

A third relay connect portion 10 including a third contact 9 is disposed between the first relay connect portion 4 and second relay connect portion 5. On the other hand, the movable member 7 is provided with a fourth contact 11. As shown in the left half of FIG. 1, the fourth contact 11 is in a non-contact state not contacting with the third contact 9 when the first and second contacts 3 and 6 are in the contact state contacting with each other. As shown in the right half of FIG. 1, the fourth contact 11 is in the contact state contacting with third contact 9 when the first and second contacts 3 and 6 are in the non-contact state in which the first and second contacts are out of contact with each other. Each of third and fourth contacts 9 and 11 is in the form of a ring.

A bellows 12 which is a device capable of expansion and contraction is interposed between movable member 7 and second relay connect portion 5. The bellows 12 has a double structure including an inner circumferential bellows 12*a* on an inner circumferential side and an outer circumferential bellows 12*b* on an outer circumferential side surrounding the inner circumferential bellows. The vacuum in the inside of insulating tube 2 is kept exclusively by inner circumferential bellows 12*a*. The movable member 7 and second relay control portion 5 are connected electrically exclusively by the outer circumferential bellows 12*b*. (Hereinafter, inner circumferential bellows 12*a* is referred to as sealing bellows, and outer circumferential bellows 12*b* is referred to as conducting bellows.)

Following is detailed explanation on insulating tube 2, first relay connect portion 4, second relay connect portion 5, third relay connect portion 10, bellows 12, etc.

Insulating tube 2 is made up of first, second and third tube sections 2*a*~2*c*, and is made of ceramics. Among these three tube sections 2*a*~2*c*, it is optional to omit the third tube section 2*c*. In this case, later-mentioned operating mechanism receiving section 14 and connecting member 15 are made of insulating material such as ceramics.

First relay connect portion 4 is shaped like a circular disk and fixed to the upper end of first tube section 2*a* to close and seal the opening. The first contact 3 is provided or attached in a center portion of the lower surface of first relay connect portion 4.

Second relay connect portion 5 includes a shaft receiving hole 5*a* formed in a center portion of second relay connect portion 5, and arranged to receive a shaft portion 7*b* of movable member 7 as explained next. Second relay connect portion 5 is clamped and fixed between the second tube section 2*b* and third tube section 2*c*.

Movable member 7 includes a flange portion 7*a* and a shaft portion 7*b*. The flange portion 7*a* is shaped like a circular disk and provided with the second contact 6 in a central portion of the upper surface of flange portion 7*a*. The shaft portion 7*b* is provided in a central portion of the lower surface of flange portion 7*a* and has a diameter smaller than that of flange portion 7*a*.

The second contract 6 is provided in the central portion of the upper surface of flange portion 7*a*. The ring-shaped or annular fourth contact 11 is provided in a peripheral portion of the lower surface of flange portion 7*a*, at a position confronting the third contact 9. Flange portion 7*a* is made of conductive material, such as copper alloy, having a good conductivity.

The shaft portion 7*b* extends through the shaft receiving hole 5*a* of second relay connect portion 5, and projects downwards below the second relay connect portion 5. The forward end of shaft portion 7*b* is connected through an insulating rod 13 with the operating mechanism 8. Shaft portion 7*b* is made of material such as stainless steel.

The operating mechanism 8 employs an air cylinder. Operating mechanism 8 is received in the operating mechanism receiving portion 14. An upper end of operating mechanism receiving portion 14 is connected through the connecting member 15 with the lower end of third tube section 2*c*.

Third relay connect portion 10 includes a ring-shaped or annular main body 10*a* and a lead portion connected continuously with the ring-shaped main body 10*a*. The ring-shaped main body 10*a* includes an outer circumferential portion clamped between the first tube section 2*a* and second tube section 2*b* and an inner circumferential portion projects inwards in the insulating tube 2. The ring-shaped or annular third contact 9 is fixed to the upper surface of the inner circumferential portion of ring-shaped main body 10*a*, at a position confronting the fourth contact 11.

The bellows 12 is constructed as follows. As mentioned before, bellows 12 has the double structure, and includes the sealing bellows 12*a* on the inner circumferential side and the conducting bellows 12*b* on the outer circumferential side.

The sealing bellows 12*a* for sealing is disposed around the shaft portion 7*b* of movable member 7 and surrounds the shaft portion 7*b*. One end of sealing bellows 12*a* is attached to second relay connect portion 5. The other end of sealing bellows 12*a* is attached to the flange portion 7*a* of movable member 7. Sealing bellows 12*a* is constructed to have an ability of sealing to prevent outside air from entering the inside of insulating tube 2 through the shaft receiving hole 5*a*. Sealing bellows 12*a* is made of material having airtightness, adequate for airtight sealing.

The conducting bellows 12*b* for electric conduction on the outer circumferential side is disposed around the sealing bellows 12*a*. Like the sealing bellows 12*a*, the conducting bellows 12*b* has one end attached to second relay connect portion 5, and other end attached to the flange portion 7*a*. Conducting bellows 12*b* electrically connects the movable member 7 and second relay connect portion 5 with each other. Conducting bellows 12*b* is made of conductive material.

The above-mentioned vacuum relay 1 provides operations and effects as follows. When the first contact 3 and second contact 6 are set in contact with each other, as shown in the left half of FIG. 1, then the first relay connect portion 4 and second relay connect portion 5 are electrically connected with each other through movable member 7 and conducting bellows 12*b*, and the first relay connect portion 4 and second relay connect portion 5 are set in the state capable of conducting electricity.

When the movable member 7 is moved toward operating mechanism 8 by operating mechanism 8 from the state shown in the left half of FIG. 1, then the first contact 3 and second contact 6 are brought out of contact as shown in the right half of FIG. 1. Therefore, the first relay connect portion 4 and second relay connect portion 5 are disconnected electrically from each other. On the other hand, the third contact 9 and fourth contact 11 are set in contact with each other, and hence the second relay connect portion 5 and third relay connect portion 10 are electrically connected with each other through movable member 7 and conducting bellows 12*b*.

In this embodiment, the third contact 9 and fourth contact 11 are ring-shaped or annular whereas the first contact 3 and second contact 6 are in the form of small projections of a circular shape located on the a center line CL of insulating tube 2. However, the first contact and 3 and second contact 6 may be ring-shaped or annular like the third contact 9 and fourth contact 11. The construction employing the first contact 3 and second contact 6 shaped in the same shape as the third contact 9 and fourth contact 11 makes it possible to reduce the number of parts (the kinds of parts), to reduce the difference in the characteristics in the changeover operation of this relay and to facilitate the circuit design in using this relay.

Since the conducting bellows 12*b* of this embodiment is used as electric path, the conducting bellows 12*b* is made of material such as copper alloy, having superior conductivity. On the other hand, the sealing bellows 12*a* and shaft portion 7*b* may be made of material such as stainless steel. In the case of the construction in which the flange portion 7*a* of movable member is small and the bellows is attached directly to the shaft portion 7*b*, it is desirable to use material superior in conductively as the material of shaft portion 7*b*. Furthermore, it is possible to employ a single bellows for both the air-tight sealing and the electric conduction.

EXPLANATION OF REFERENCE NUMERALS

1 . . . vacuum relay
2 . . . insulating tube
3 . . . first contact
4 . . . first relay connect portion
5 . . . second relay connect portion
6 . . . second contact
7 . . . movable member
7*a* . . . flange portion
7*b* . . . shaft portion
8 . . . operating mechanism
9 . . . third contact
10 . . . third relay connect portion
11 . . . fourth contact
12 . . . bellows
12*a* . . . inner circumferential bellows (sealing bellows)
12*b* . . . outer circumferential bellows (conducting bellows)

The invention claimed is:

1. A sealed relay comprising: an insulating tube; a first relay connect portion attached to an opening portion in one end of the insulating tube, and provided with a first contact on an inside surface of the first relay connect portion; a second relay connect portion disposed with a predetermined spacing from the first relay connect portion; a movable member disposed movably between the first and second relay connect portions, and provided with a second contact contacting with the first contact when the movable member is moved toward the first relay connect portion; an operating mechanism to move the movable member in a direction for contact and separation between the contacts; and a bellows to seal an inside of the insulating tube airtightly;

the sealed relay being arranged to set the first contact and the second contact in contact with each other by moving the movable member with the operating mechanism and thereby to connect the first and second relay connect portions electrically through the movable member and the bellows;

the sealed relay further including a third relay connect portion including a third contact and being provided between the second relay connect portion and the first relay connect portion; and the movable member being provided with a fourth contact contacting with the third contact when the first contact and the second contact are set out of contact from each other;

the bellows having a double structure including an inner circumferential bellows and an outer circumferential bellows, the inner circumferential bellows being configured to have a property for air tight sealing, and the outer circumferential bellows being configured to have a property for electric conduction.

2. The sealed relay as claimed in claim 1, wherein the third and fourth contacts are ring-shaped contacts having substantially equal diameters.

3. The sealed relay as claimed in claim 2, wherein the first and second contacts are ring-shaped contacts having diameters substantially equal to the diameters of the third and fourth contacts.

* * * * *